US009784422B2

(12) United States Patent
Zhang et al.

(10) Patent No.: US 9,784,422 B2
(45) Date of Patent: Oct. 10, 2017

(54) SELF-CENTERING HYPERBOLIC TRIM

(71) Applicant: ABL IP Holding LLC, Decatur, GA (US)

(72) Inventors: Hui Zhang, Aurora, IL (US); Kerry S. Collins, Island Lake, IL (US); Joseph Stauner, Algonquin, IL (US)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 14/630,026

(22) Filed: Feb. 24, 2015

(65) Prior Publication Data

US 2015/0241037 A1 Aug. 27, 2015

Related U.S. Application Data

(60) Provisional application No. 61/945,388, filed on Feb. 27, 2014.

(51) Int. Cl.

| | |
|---|---|
| ***F21S 8/02*** | (2006.01) |
| ***F21V 21/04*** | (2006.01) |
| ***F21V 13/04*** | (2006.01) |
| ***F21V 7/07*** | (2006.01) |
| ***F21V 17/16*** | (2006.01) |
| *F21Y 115/10* | (2016.01) |

(52) U.S. Cl.

CPC ..... *F21S 8/026* (2013.01); *F21V 7/07* (2013.01); *F21V 13/04* (2013.01); *F21V 17/16* (2013.01); *F21Y 2115/10* (2016.08)

(58) Field of Classification Search

CPC ..... F21S 8/026; F21V 13/04; F21V 17/16; F21V 7/07

USPC ..... 362/442, 434

See application file for complete search history.

(56) References Cited

U.S. PATENT DOCUMENTS 1,168,553 A * 1/1916 Richmond et al. ..... F21V 17/00 362/434

8,727,574 B2 * 5/2014 Simchak ..... F21K 9/52 362/296.07

(Continued)

OTHER PUBLICATIONS

Office Action for Mexican Application No. MX 2015/002522, dated Dec. 5, 2016 (3 pages English Translation; 3 pages MX OA), 6 pages.

*Primary Examiner* — Andrew Coughlin
*Assistant Examiner* — Eric T Eide
(74) *Attorney, Agent, or Firm* — Kilpatrick Townsend & Stockton, LLP

(57) ABSTRACT

A self-centering hyperbolic trim assembly is provided for a recessed light fixture. The trim assembly includes a mixing chamber, a hyperbolic reflector and a reflector mounting assembly to mount the hyperbolic reflector without rigid attachment in an optic housing of the recessed light fixture. The mixing chamber is top mounted by its chamber holder portion over an LED light source in the optic housing. The mixing chamber has a light transmitting chamber body held within the chamber holder portion, whereby a space is formed between the chamber holder and the light transmitting chamber body. This space is sufficient to accept the free upper end of the hyperbolic reflector therein, thus creating a self-centering interference fit between the mixing chamber and the reflector, while protecting the LED light source, when the light fixture is assembled, thereby maintaining consistent light output and patterning.

16 Claims, 5 Drawing Sheets

(56) References Cited

U.S. PATENT DOCUMENTS

| | | | | |
|---|---|---|---|---|
| 8,858,045 | B2 * | 10/2014 | Harbers | F21V 29/00 362/249.02 |
| 2006/0279954 | A1 * | 12/2006 | Sherman | F21S 8/06 362/353 |
| 2011/0134650 | A1 * | 6/2011 | Verma | F21V 21/04 362/362 |
| 2011/0216522 | A1 * | 9/2011 | Harbers | F21K 9/50 362/84 |
| 2012/0140490 | A1 * | 6/2012 | Rowlette, Jr. | F21K 9/00 362/373 |
| 2012/0262928 | A1 * | 10/2012 | Matsuda | F21S 8/026 362/373 |
| 2013/0271982 | A1 * | 10/2013 | Rodriguez | F21V 15/01 362/235 |
| 2014/0168944 | A1 * | 6/2014 | Osada | F21V 17/14 362/95 |
| 2014/0204594 | A1 * | 7/2014 | Kanazawa | F21K 9/30 362/362 |
| 2015/0043224 | A1 * | 2/2015 | Chen | F21V 31/005 362/365 |

* cited by examiner

SELF-CENTERING HYPERBOLIC TRIM

RELATED CASES

The present application claims priority under 35 U.S.C. §119(e) based on U.S. Provisional Application Ser. No. 61/945,388 filed on Feb. 27, 2014, which is incorporated by reference herein in its entirety.

FIELD

The present disclosure is related to a recessed light fixture, and more particularly, to a self-centering hyperbolic trim for a recessed light fixture.

BACKGROUND

Lighting designers typically evaluate the quality of a recessed light fixture based on how well the recessed fixture blends into a ceiling and how well the recessed fixture controls glare from a light source. Ideally, lighting designers prefer a "quiet" ceiling in which light is emitted without the recessed fixture and/or light source being noticeable. In other words, the ceiling should be free of concentrated light spots (i.e., "hot spots") that are produced by the recessed fixtures mounted in the ceiling.

Traditional light sources include incandescent, high-intensity discharge (HID), and compact-fluorescent (CFL) light sources, all of which emit light in all directions (i.e., non-directional light beam). To direct the non-directional light beam down from and out of a recessed fixture, lighting manufacturers have traditionally designed reflectors using a parabolic shape, which is intended to focus the non-directional light beam toward an illuminated target (e.g., a floor surface).

Rapid advancements in light-emitting diode ("LED") technology have caused manufacturers to replace the traditional light sources with LED light sources, which are inherently directional light sources. However, the manufacturers have continued using traditional reflectors (e.g., parabolic-shaped reflectors) to minimize glare and to provide a "quiet" ceiling. The combination of LED light sources with traditional reflectors fails to provide optimal lighting results.

A hyperbolic reflector has been designed for use with a LED light source in a recessed light fixture to eliminate concentrated light spots. One installation approach involves connecting the hyperbolic reflector to a mounting ring using a chemical adhesive, such as glue, and then mounting the connected components into an optic housing with the LED light source. However, the use of adhesives in connecting the hyperbolic reflector to the mounting ring can result in the LED light source being slightly off-center or misaligned relative to the upper opening, and thus, also the bottom opening (also referred to as the reflector aperture) of the reflector, when the reflector is mounted in the optic housing. A minor deviation in the alignment between the LED light source and the reflector aperture can result in a significant efficiency drop and undesirable light pattern variance in the operation of the recessed light fixture. These lighting problems become more pronounced when several of these types of recessed light fixtures are installed side by side, with one or more of them having alignment variations between their LED light source and reflector aperture that exceed acceptable tolerances.

SUMMARY

To address these and other shortcomings, an improved hyperbolic trim assembly is provided for a recessed light fixture having an optic housing (e.g., a housing or mounting frame) with an LED light source connected therein. The hyperbolic trim assembly includes a miniature mixing chamber for the LED light source, and a hyperbolic reflector with a reflector mounting assembly to connect the hyperbolic reflector inside of the optic housing. The hyperbolic reflector has a narrow top opening, a wide bottom opening and a hyperbolic wall extending from the top opening toward the bottom opening. The mixing chamber is "miniature" in that the chamber, or a portion thereof, is sized to fit inside of the hyperbolic reflector through the narrow top opening at a substantially central position, when the hyperbolic reflector is inserted and pressed into the optic housing and mounted therein with the reflector mounting assembly. The reflector mounting assembly aligns the hyperbolic reflector relative to the mixing chamber, when the hyperbolic reflector is mounted in the optic housing. The mixing chamber is an intermediate optical component, which is interposed between the LED light source and the hyperbolic reflector to guide light from the LED light source directly into a center of the hyperbolic trim, and thus, to ensure alignment therebetween, when the hyperbolic reflector is mounted inside of the optic housing with the reflector mounting assembly. Thus, the hyperbolic trim assembly is self-centering.

For example, the mixing chamber includes an opening on a first end to receive the LED light source, and an optical lens on an opposite second end through which light from the LED light source exits. The mixing chamber is mechanically connected, such as to an optic mount in the optic housing, to receive light from the LED light source. Once the mixing chamber is connected in the optic housing in relation to the LED light source, the hyperbolic reflector can then be inserted and pressed into the optic housing until the second end of the mixing chamber is received inside of the hyperbolic reflector through the narrow top opening and a bottom of the hyperbolic reflector is aligned with (e.g., abuts against) a bottom of the optic housing. The reflector mounting assembly includes mounting hardware, such as mounting springs (e.g., torsion springs), which aligns the hyperbolic reflector to the mixing chamber, and thus, the LED light source, when the hyperbolic reflector is inserted and mounted in the optic housing. When aligned, the second end of the mixing chamber is substantially centered inside of the hyperbolic reflector relative to the wide bottom opening (also referred to as the reflector aperture). The mixing chamber can then guide light from the LED light source directly into a center of the hyperbolic reflector via the second end. The optical lens of the mixing chamber can be a light diffusing lens to soften an intensity of the light emitted from the LED light source.

Accordingly, the hyperbolic trim assembly provides a customer-friendly installation experience and achieves a high aesthetic appeal on the visible surfaces of the assembled hyperbolic trim. In particular, the two part assembly, namely the mixing chamber assembly and the hyperbolic reflector assembly, provides a self-centering configuration which allows for relatively large tolerances in the installation process and does not require the use of adhesives during field installation. Thus, the hyperbolic trim assembly is able to maintain optimized light patterns, and a stably high efficiency of light output without requiring a fine-tune height adjustment in field installation. Furthermore, the use of a miniature mixing chamber, which is able to fit into the narrow top opening of the hyperbolic reflector, allows the hyperbolic trim assembly to maintain aesthetic appeal. In addition, the hyperbolic trim assembly can provide other optical improvements, such as diffusion for more even distribution onto the reflector surface and beyond, diffusion to reduce direct and/or reflected glare, light leak prevention, and protection of the LED light source from damage during shipping and/or installation.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

Figure 1:
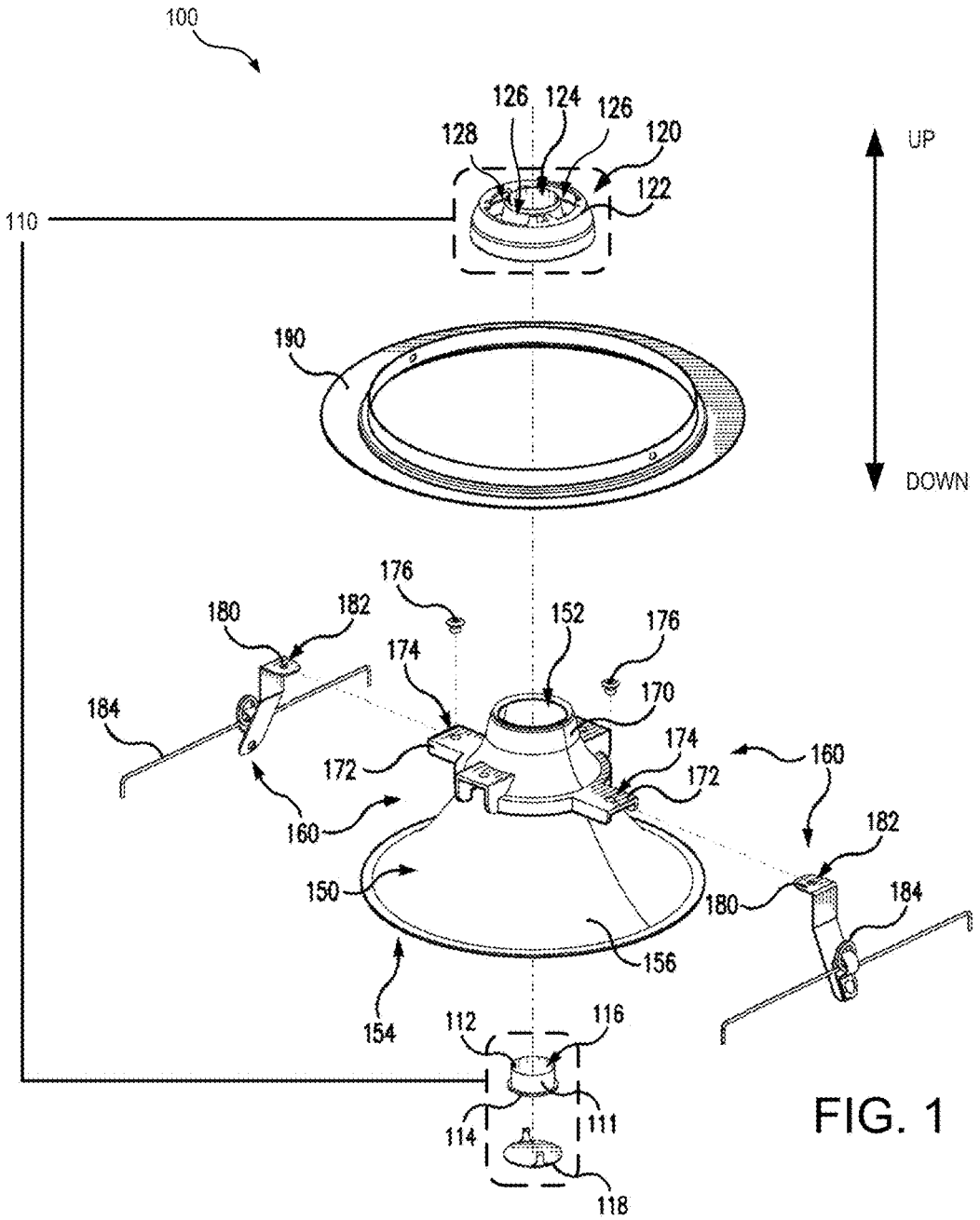
FIG. 1 illustrates an exploded view of example components of a hyperbolic trim assembly for a recessed light fixture, in accordance with an exemplary embodiment of the present disclosure.

FIG. 1 illustrates a hyperbolic trim assembly 100 for a recessed light fixture (FIG. 3) that includes an optic housing with an LED light source therein as further explained below. The hyperbolic trim assembly 100 includes a miniature mixing chamber 110, a hyperbolic reflector 150, and reflector mounting assembly 160. The hyperbolic trim assembly 100 can also include a trim ring 190 connectable to a bottom of the hyperbolic reflector 150. As will be described in further detail below, the miniature mixing chamber 110 and the reflector mounting assembly 160 together facilitate self-centering, and thus alignment, of the hyperbolic reflector in relation to the LED light source, when the hyperbolic trim assembly 100 is installed inside of the optic housing (see e.g., FIGS. 3 and 4).

The mixing chamber 110 is used to direct light from an LED light source directly into the hyperbolic reflector 150. The mixing chamber 110 includes a hollow chamber body 111 (e.g., a cylinder) having a first end 112 and an opposite second end 114. The first end 112 has a chamber opening 116 for an LED light source. The second end 114 has an optical lens 118, such as a light diffusing lens to soften an intensity of light passing therethrough. The mixing chamber 110 also includes a chamber holder 120. The chamber holder 120 includes a continuous outer rim 122 and a central through-hole 124 in which to retain the chamber body 111. The chamber holder 120 also includes a chamber mounting assembly, such as spaced-apart arc-shaped slot(s) 126 to engage corresponding mounting tabs of an optic mount of an optic housing (see e.g., 332 at FIG. 4). Each of the slots 126 have a narrow portion 128 to prevent removal of a respective mounting tab of the optic mount when engaged and twisted in the slot to the narrow portion 128. The mixing chamber 110 and its components can be formed as separate pieces such as shown in FIG. 1, or as a single piece or unitary component. For example, the chamber body 111 and the chamber holder 120 can be integrated into a single piece or unitary component.

The mixing chamber 110 is to be top mounted by the chamber holder 120 over an LED light source in the optic housing. The chamber body 111, which is light transmitting, is held within the chamber holder 120, whereby a space is formed between the chamber holder 120 and the chamber body 111. This space is sufficient to accept a free upper end of the hyperbolic reflector 150 therein, thus creating a self-centering interference fit between the mixing chamber 110 and the hyperbolic reflector 150, while protecting the LED light source, when the recessed light fixture is assembled, thereby maintaining consistent light output and patterning.

The hyperbolic reflector 150 includes a narrow top opening 152, a wide bottom opening 154 and a hyperbolic wall 156 extending continuously between the narrow top opening 152 (e.g., a narrow neck) and the wide bottom opening 154 (e.g., a wide bell). The hyperbolic wall 156 is shaped to achieve a curvature that curves inwardly toward a longitudinal axis of the hyperbolic reflector 150 similar to a trumpet bell from the narrow top opening 152 toward the wide bottom opening 158. The hyperbolic shape of the hyperbolic wall 156 can be configured based on various design factors, including, for example, light distribution requirements, size of a LED light source, height of the hyperbolic reflector 150, size of the wide bottom opening 154 (also referred to as the aperture diameter), or other factors. The trim ring 190 can be connected to a bottom of the hyperbolic reflector 150 around the wide bottom opening 154, such as with fastener(s) (e.g., a screw(s)).

The reflector mounting assembly 160 is connected to the hyperbolic reflector 150, and is used to mechanically connect the hyperbolic reflector 150 in an optic housing of a recessed light fixture. The reflector mounting assembly 160 also aligns the hyperbolic reflector 150 to the mixing chamber 110, when the hyperbolic reflector 150 is mounted in an optic housing. The reflector mounting assembly 160 includes a reflector mounting frame 170, which has a hyperbolic shape and is connected around an exterior, narrow neck of the hyperbolic reflector 150. The reflector mounting frame 170 includes two bracket supports 172, which extend outwards from a bottom of the reflector mounting frame 170. The bracket supports 172 are arranged on opposite sides of the hyperbolic reflector 150. Each of the bracket supports 172 includes a fastener hole 174 to receive a fastener 176, such as a screw. The reflector mounting frame 170 accepts two spring brackets 180 which hold a corresponding mounting spring 184, such as a torsion spring with two arms extending from a center coil. The torsion springs can provide a mechanical stop and improved product safety. Each of the spring brackets 180 includes a fastener hole 182. Each of the spring brackets 180 is connected to a corresponding bracket support 172 by connecting a fastener 176 into the fastener holes 174 and 182.

Figure 2:
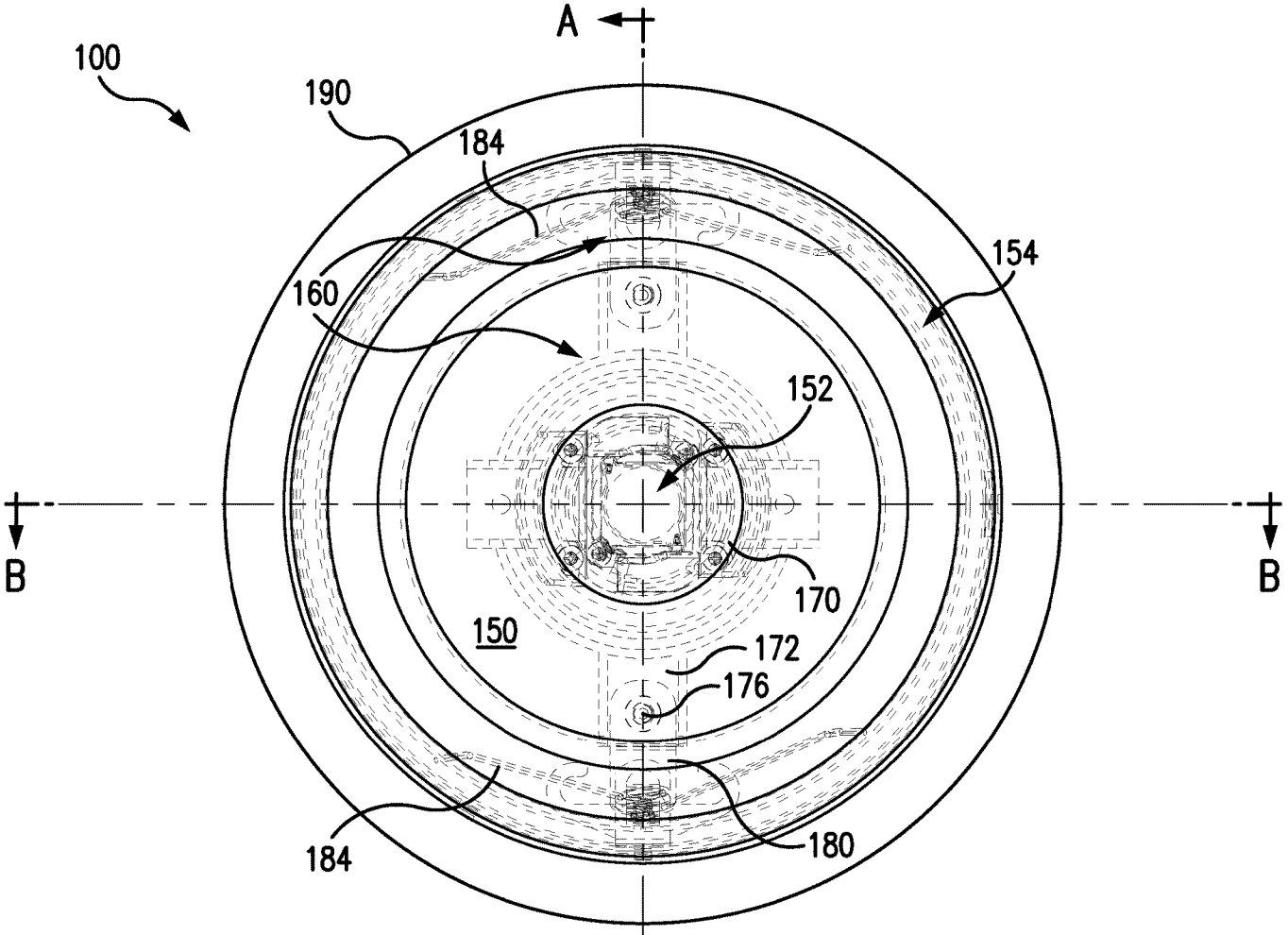
FIG. 2 illustrates a bottom view of the hyperbolic trim assembly of FIG. 1, particularly a hyperbolic reflector and a reflector mounting assembly, which is to be mounted in an optic housing of a recessed light fixture.

FIG. 2 illustrates a bottom view of the hyperbolic trim assembly 100. As shown in FIG. 2, the trim ring 190 extends around the wide bottom opening 154 of the hyperbolic reflector 150. The various components of the reflector mounting assembly 160 are shown in phantom, such as the reflector mounting frame 170, the bracket supports 172, the fasteners 176, the spring brackets 180 and the mounting springs 184.

Figure 3:
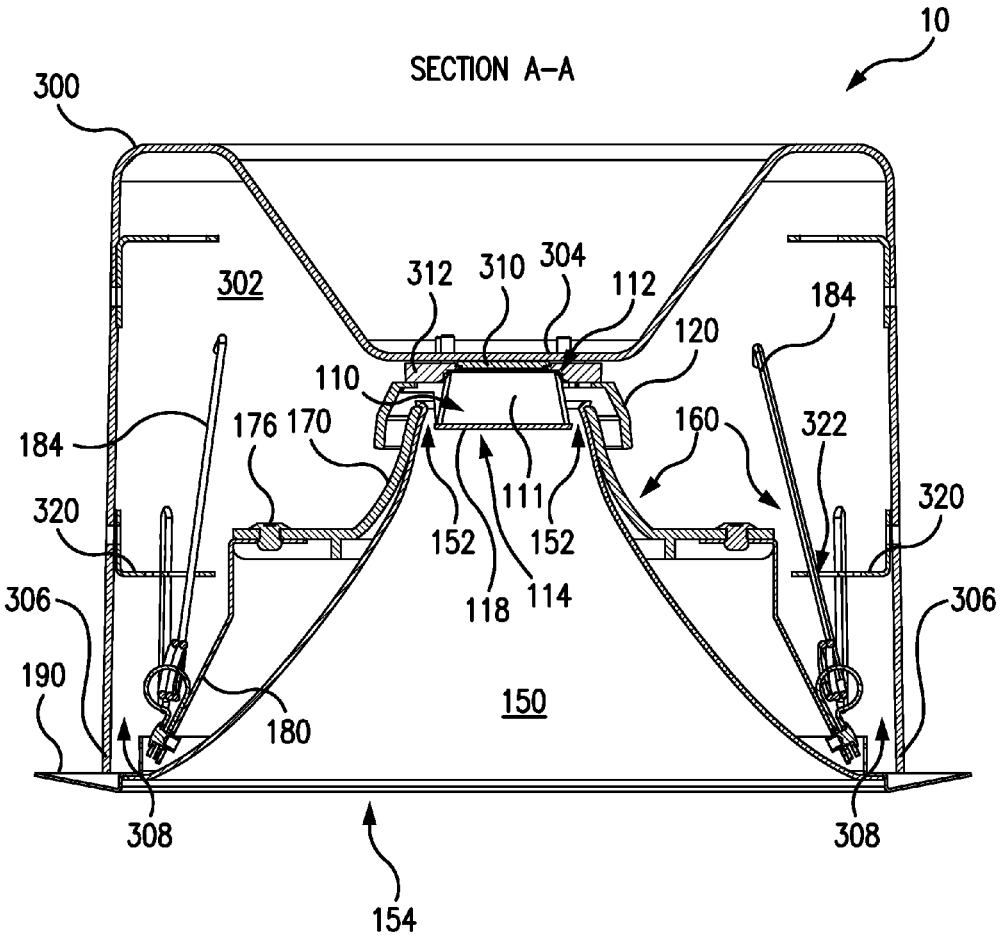
FIG. 3 illustrates a sectional view taken along section A-A in FIG. 2 of the hyperbolic trim assembly, which is mounted in the optic housing of a recessed light fixture.

FIG. 3 illustrates a sectional view taken along section A-A in FIG. 2 of the hyperbolic trim assembly 100, when mounted in an optic housing 300 (e.g., a housing or mounting frame) of a recessed light fixture 10. In this example, the optic housing 300 is a canister, and includes a cavity 302 and a bottom 306 with a housing opening 308 through which to receive the components of the hyperbolic trim assembly 100. The optic housing 300 also includes an LED light source 310 centrally connected in the cavity 302 to an inner wall 304 by an LED connector 312. The inner wall 304 is substantially parallel to the bottom 306 of the optic housing 300 with the housing opening 308. The optic housing 300 also includes mounting brackets 320 to engage respective mounting springs 184 for mounting the hyperbolic reflector 150 in the optic housing 300. Each of the mounting brackets 320 can include a spring slot 322 (e.g., a C-shaped spring slot) to receive both arms of a respective mounting spring 184, in this example a torsion spring, of the reflector mounting assembly 160, when connecting the hyperbolic reflector 150 into the optic housing 300. The reflector mounting assembly 160 is a floating assembly, which allows for greater adjustability of the hyperbolic reflector 150 inside of the cavity 302 during installation.

When the hyperbolic reflector 150 is mounted inside of the optic housing with the trim ring 190 flush against the bottom 306 of the optic housing 300, the reflector mounting assembly 160 aligns the hyperbolic reflector 150 to the mixing chamber 110, and thus, the LED light source 310. When aligned, the second end 114 of the chamber body 111 of the mixing chamber 110 is centrally positioned inside of the hyperbolic reflector 150 through the narrow top opening 152 relative to the wide bottom opening 154 (e.g., the reflector aperture), as shown in FIG. 3. Thus, the mixing chamber 110 and the reflector mounting assembly 160 cooperate to facilitate self-centering, and thus, alignment, of the hyperbolic reflector 150 relative to the LED light source, when installing the hyperbolic trim assembly 100 into the optic housing 300. As a consequence, the hyperbolic trim assembly 100 is able to maintain optimized light patterns, and a stably high efficiency of light output without requiring a fine-tune height adjustment in field installation. Furthermore, the use of a "miniature" mixing chamber 110 allows the hyperbolic trim assembly 100 to maintain aesthetic appeal. In this example, the mixing chamber 110, particularly the chamber body 111, has a frustoconical shape, which tapers outward from the first end 112 toward the second end 114.

Figure 4:
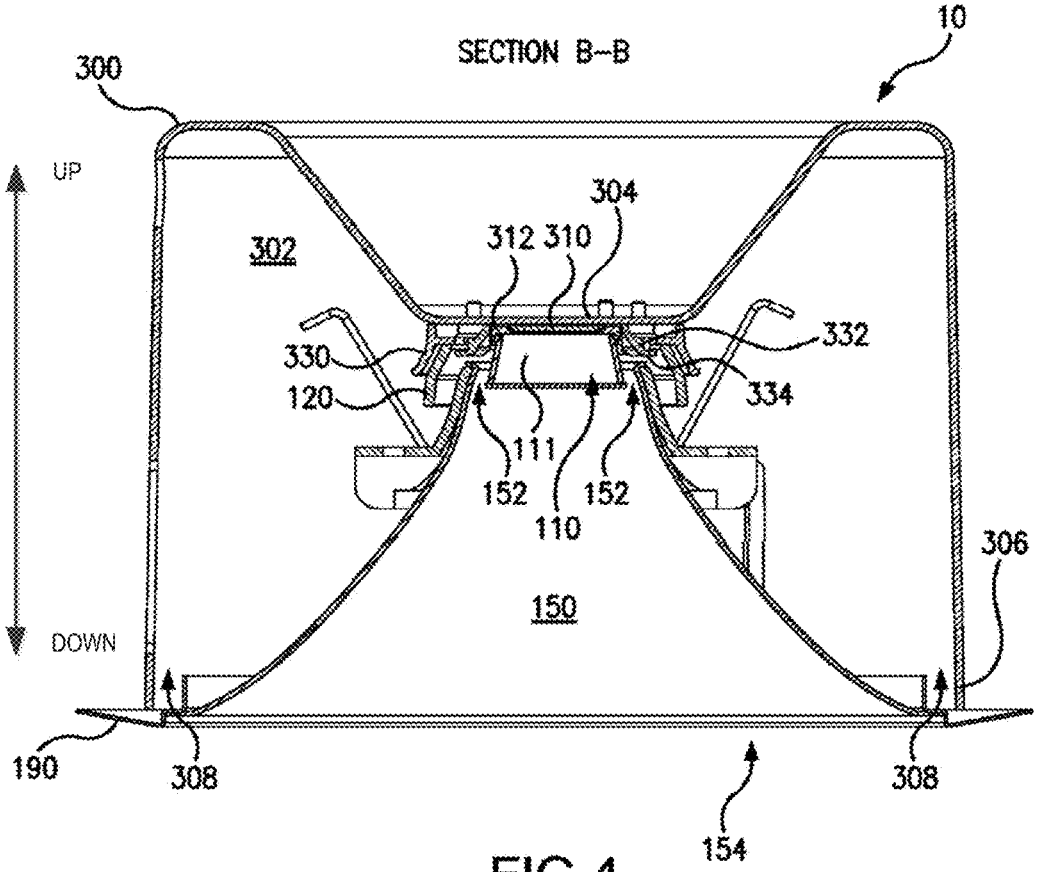
FIG. 4 illustrates a sectional view taken along section B-B in FIG. 2 of the hyperbolic trim assembly, which is mounted in the optic housing of a recessed light fixture.

FIG. 4 illustrates a sectional view taken along section B-B in FIG. 2 of the hyperbolic trim assembly 100, when mounted in the optic housing 300 of the recessed light fixture 10. As further shown in FIG. 4, the optic housing 300 also includes an optic mount 330 connected to the inner wall 304 around or adjacent to the LED light source 310. In this example, the optic mount 330 is a twist-type mount, which includes spaced-apart mounting tabs 332. Each of the mounting tabs 332 extends in a downward direction and includes a flanged end 334. To connect the mixing chamber 110 to the optic mount 330, the arc-shaped slots 126 are aligned and then engaged with the mounting tabs 332 at an open position. The mixing chamber 110 is then twisted to a locked position, where the arc-shaped slots 126 narrow (e.g., the narrow portion 128 in FIG. 1) to prevent removal of the flanged ends 334 of the mounting tabs 332 therefrom, thereby connecting the mixing chamber 110 to the optic mount 330. In the locked position, an open end of the mixing chamber 110 with the chamber opening 116 is flush against a surface of the optic mount 330, and surrounds the LED light source 310 to reduce or eliminate light leakage from the mixing chamber 110 during operation of the LED light source 310.

Figure 5:
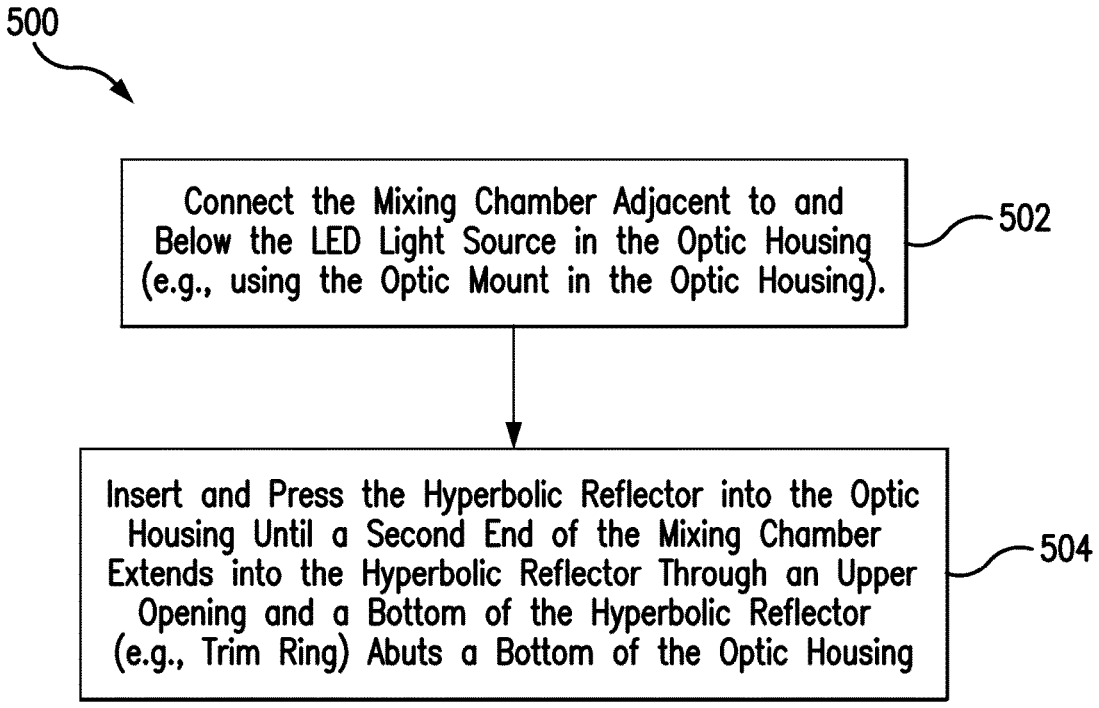
FIG. 5 illustrates an example process by which the hyperbolic trim assembly of FIGS. 1-4 is installed in an optic housing of a recessed light fixture.

FIG. 5 illustrates an example process 500 by which the hyperbolic trim assembly 100 of FIGS. 1-4 is installed in an optic housing of a recessed light fixture that is mountable or mounted in a ceiling. At reference 502, the mixing chamber 110 is connected adjacent to and below the LED light source 310 to receive and direct the light received from the LED light source 310. For example, the mixing chamber 110 is connected to the optic mount 330 around and adjacent to the LED light source 310 in the optic housing 300. The mixing chamber 110 is initially engaged to the optic mount 330 so that the flanged ends 334 of the mounting tabs 332 of the optic mount 330 extend into respective slots 126 of the mixing chamber 110 in the open position. Thereafter, the mixing chamber 110 is twisted (e.g., clockwise or counter-clockwise) to the locked position, where the slots 126 narrow to prevent removal of the flanged ends 334 of the mounting tabs 332 from respective slots 126.

At reference 504, the hyperbolic reflector 150 is inserted and pressed into the cavity 302 of the optic housing 300, and mounted in the optic housing 300 using the reflector mounting assembly 160. When the hyperbolic reflector 150 is mounted in the optic housing 300, the second end 114 of the mixing chamber 110 is positioned inside of the hyperbolic reflector 150 through the narrow top opening 152 and a bottom of the hyperbolic reflector 150 (e.g., the trim ring 190) abuts against the bottom 306 of the optic housing 300. The reflector mounting assembly 160 aligns the hyperbolic reflector 150 to the mixing chamber 110, and thus, the LED light source 310. When aligned, the second end 114 of the mixing chamber 110 is centrally positioned inside of the hyperbolic reflector 150 relative to the wide bottom opening 154.

In this particular example, the reflector mounting assembly 160 uses mounting springs 184, such as torsion springs, which further simplify installation of the hyperbolic reflector assembly in the optic housing 300. For example, as previously discussed, each torsion spring (e.g., 184) can have two arms extending from a center coil. During installation, the two arms of each torsion spring are compressed, and engaged (e.g., snapped into) to a spring slot 322 of a respective mounting bracket 320. Thereafter, the hyperbolic reflector 150 and the reflector mounting assembly 160 is inserted and pressed into the optic housing 300, with the arms of the torsion springs sliding in the spring slots 322 and guiding the hyperbolic reflector 150 until the trim ring 190 abuts the bottom 306 of the optic housing 300. When the trim ring 190 abuts the bottom 306 of the optic housing, the second end 114 of the mixing chamber 110 is centrally positioned in the hyperbolic reflector 150 through the narrow top opening 152 so that the hyperbolic reflector 150 is in alignment with the mixing chamber 110, and thus, the LED light source 310, as shown in FIGS. 3 and 4.

The hyperbolic trim assembly 100 can be installed in an optic housing 300, which is either already mounted in a ceiling or to be mounted in a ceiling after the hyperbolic trim assembly 100 is installed therein.

It should be understood that the hyperbolic trim assembly 100, as described with reference to FIGS. 1-5, is provided as an example. The size and shape of the various components of the hyperbolic trim assembly can be modified according to the lighting application. Furthermore, the optic mount of the optic housing can employ other types of mechanical connectors (e.g., screws, etc.), to connect the miniature mixing chamber thereto relative to the LED light source. For example, the mixing chamber can have a chamber mounting assembly having hook-shaped or C-shaped mounting tabs, which are spaced-apart along a periphery of the open end of the mixing chamber. Each mounting tab engages a shaft portion of a respective screw on the optic mount when the mixing chamber is twisted (e.g., in a clockwise or counter-clockwise direction). Once the mounting tabs are engaged (e.g., hooked around) to a respective screw, the screws can be tightened to clamp the mounting tab between a screw head and a surface of the optic mount, thereby connecting the mixing chamber to the optic mount.

In addition, the reflector mounting assembly can employ mounting springs, other than torsion springs, to connect the hyperbolic reflector in an optic housing. The reflector mounting assembly can also employ other mechanical fasteners to connect the hyperbolic reflector in an optic housing, when the bottom of the hyperbolic reflector (e.g., the trim ring) is aligned with the bottom of an optic housing (e.g., flush or abuts the bottom of the optic housing).

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. A trim assembly for a recessed light fixture mountable in a ceiling, the recessed light fixture having an optic housing including therein an LED light source, the trim assembly comprising:

a hollow mixing chamber body, including a first end and an opposite second end, the first end forming a first round chamber opening, the first round chamber opening being configured to receive light from the LED light source, the second end forming a second round chamber opening that is at least as large as the first round chamber opening, the hollow mixing chamber body being configured to direct the light from the LED light source through the second end;

a chamber holder that includes:

an inner rim that defines a central through-hole therethrough, for the hollow mixing chamber body, and an outer rim disposed outwardly from the inner rim, wherein the outer rim and the inner rim form a space therebetween, wherein the chamber holder forms a chamber mounting assembly to position the hollow mixing chamber body relative to the LED light source within the optic housing;

a hyperbolic reflector having an upper neck that forms a top opening larger than the second round chamber opening, a bottom opening that is larger than the top opening, and a hyperbolic wall extending from the upper neck toward the bottom opening, wherein:

a direction from the top opening toward the bottom opening defines a vertically downward direction, and the second end of the hollow mixing chamber body is positioned in the hyperbolic reflector through the top opening, when the hollow mixing chamber body is inserted into the optic housing; and a reflector mounting assembly comprising a reflector mounting frame that receives and extends around the upper neck of the hyperbolic reflector, wherein the upper neck of the hyperbolic reflector is received between the inner rim and the outer rim of the chamber holder, and retained via an interference fit that centers the hyperbolic reflector within the optic housing.

2. The trim assembly of claim 1, wherein the hollow mixing chamber body is retained within the central through-hole of the chamber holder.

3. The trim assembly of claim 1, wherein the chamber mounting assembly includes a plurality of spaced-apart arc-shaped slots, formed between the inner rim and the outer rim, to engage respective downward extending mounting tabs of the optic housing.

4. The trim assembly of claim 3, further comprising the optic housing and the LED light source, and wherein each mounting tab forms a corresponding flanged end at a lowermost end thereof to engage respective ones of the arc-shaped slots of the chamber mounting assembly.

5. The trim assembly of claim 4, wherein the hollow mixing chamber body guides light emitted from the LED light source directly into the hyperbolic reflector, when the hollow mixing chamber body is connected to the optic housing.

6. The trim assembly of claim 4, wherein:

each of the spaced-apart arc-shaped slots includes a wide portion and a narrow portion;

each of the mounting tabs is sized and configured to pass freely through a corresponding one of the wide portions of the spaced-apart arc-shaped slots;

and each of the flanged ends is configured to engage with the narrow portions of the spaced-apart arc-shaped slots by twisting the hollow mixing chamber body, to lock the hollow mixing chamber body to the optic housing.

7. The trim assembly of claim 1, wherein the reflector mounting assembly further comprises a plurality of mounting springs that support the hyperbolic reflector in the optic housing, but allow adjustability of a position of the hyperbolic reflector within the optic housing.

8. The trim assembly of claim 7, wherein the mounting springs are torsion springs.

9. The trim assembly of claim 1, further comprising:

the optic housing, having a cavity with an internal wall on one end and a housing opening on an opposite end to receive the hollow mixing chamber body and the hyperbolic reflector;

the LED light source, connected to the internal wall; and an optic mount connected to the internal wall, wherein the optic mount mechanically connects directly with the chamber holder, such that the hollow mixing chamber body is positioned below the LED light source.

10. The trim assembly of claim 9, wherein the optic mount includes a plurality of downward extending mounting tabs each having a flanged end, and the chamber mounting assembly defines a plurality of arc-shaped slots between the inner rim and the outer rim to engage respective ones of the mounting tabs.

11. The trim assembly of claim 9, wherein the internal wall is substantially parallel to a bottom of the optic housing with the housing opening.

12. The trim assembly of claim 1, wherein the hollow mixing chamber body tapers outward from the first end to the second end.

13. The trim assembly of claim 1, further comprising an optical lens that covers the second end of the hollow mixing chamber body.

14. The trim assembly of claim 13, wherein the hollow mixing chamber body is integrally formed with the optical lens.

15. The trim assembly of claim 13, wherein the optical lens is a light diffusing lens.

16. A trim assembly for a recessed light fixture mountable in a ceiling, the recessed light fixture having an optic housing including therein an LED light source, the trim assembly comprising:

a hollow mixing chamber body, including a first end and an opposite second end, the first end forming a first round chamber opening, the first round chamber opening being configured to receive light from the LED light source, the second end forming a second round chamber opening that is at least as large as the first round chamber opening, the hollow mixing chamber body being configured to direct the light from the LED light source through the second end;

a chamber holder that includes:

an inner rim that defines a central through-hole therethrough, for the hollow mixing chamber body, and an outer rim disposed outwardly from the inner rim, the outer rim and the inner rim forming a space therebetween, wherein the chamber holder forms a chamber mounting assembly to position the hollow mixing chamber body relative to the LED light source within the optic housing;

a hyperbolic reflector having an upper neck that forms a top opening larger than the second round chamber opening, a bottom opening that is larger than the top opening, and a hyperbolic wall extending from the upper neck toward the bottom opening, wherein:

a direction from the top opening toward the bottom opening defines a vertically downward direction, and the second end of the hollow mixing chamber body is positioned in the hyperbolic reflector through the top opening, when the hollow mixing chamber body is inserted into the optic housing; and a reflector mounting assembly that includes:

a reflector mounting frame directly connected with the upper neck of the hyperbolic reflector, and a pair of spring brackets connected to the reflector mounting frame, the spring brackets arranged on opposite sides of the reflector mounting frame, each spring bracket connecting a mounting spring to the hyperbolic reflector, to mount the hyperbolic reflector in the optic housing;

wherein:

the mounting springs support the hyperbolic reflector in the optic housing, but allow adjustability of a position of the hyperbolic reflector within the optic housing, and the upper neck of the hyperbolic reflector is received in the space between the inner rim and the outer rim of the chamber holder, and retained via an interference fit that centers the hyperbolic reflector within the optic housing.

* * * * *